United States Patent [19]

Umeya et al.

[11] Patent Number: 4,654,510

[45] Date of Patent: Mar. 31, 1987

[54] PTC HEATING APPARATUS

[75] Inventors: Kazumasa Umeya; Ryoichi Shioi; Hisao Senzaki, all of Nikahomachi; Hisao Nakagawa, Hachioji; Shoji Koyama; Hideshi Kataoka, both of Ichikawa, all of Japan

[73] Assignee: TDK Electronics Co., Ltd., Tokyo, Japan

[21] Appl. No.: 85,468

[22] Filed: Oct. 17, 1979

[51] Int. Cl.[4] ..... H05B 3/08

[52] U.S. Cl. ..... 219/541; 219/381; 219/553; 219/374; 219/543; 338/22 R; 338/327

[58] Field of Search ..... 219/307, 338, 381, 370, 219/374, 541, 543, 544, 553; 338/22 R, 22 SD, 283, 323, 327; 257/518, 520; 13/25

[56] References Cited

U.S. PATENT DOCUMENTS 3,927,300 12/1975 Wada et al. ..... 219/381
3,956,614 5/1976 Hervert ..... 219/541
3,995,143 11/1976 Hervert ..... 219/553
4,032,752 8/1977 Ohmura et al. ..... 219/541
4,232,214 11/1980 Shioi et al. ..... 219/541

FOREIGN PATENT DOCUMENTS 1665880 5/1975 Fed. Rep. of Germany ..... 219/553

*Primary Examiner*—Volodymyr Y. Mayewsky
*Attorney, Agent, or Firm*—Armstrong, Nikaido, Marmelstein & Kubovcik

[57] ABSTRACT

A PTC heating element with a honeycomb ceramic body comprising a barium titanate and semiconductor element, which provides the ceramic body with a positive temperature coefficient of resistance over the Curie point. An electrode is deposited on each end of the honeycomb body. The electrodes according to the present invention have a non-ohmic property, while the conventional electrodes have been ohmic. A high rush current and migration are advantageously decreased by the non-ohmic electrodes.

4 Claims, 4 Drawing Figures

E
D
500
CURRENT
(mA)
1000
200
100
2
10
20
VB
VOLTAGE (V)
100
500

PTC HEATING APPARATUS

The present invention relates to a heating apparatus and, particularly, a heating apparatus composed of a positive temperature coefficient thermister (hereinafter referred to as a PTC thermister) and a blower.

The PTC thermister is composed of barium titanate and has outstanding features, namely the fact that optional heat-generating temperatures can be obtained by adjusting the Curie point of the PTC thermister, and that there is no danger that the PTC thermister will overheat. This is because the resistance of the PTC thermister is suddenly increased at a temperature exceeding the Curie point. Accordingly, the PTC thermister is attractive because of its automatic temperature control and, therefore, has been used in various heating elements.

When a honeycomb PTC thermister body including a number of through-holes is assembled with a fan and the like for the forced circulation of air through the through-holes, it can be practically used in an air heater, hair driers and other types of driers. Since a PTC thermister in the form of a pellet does not generate a sufficient quantity of heat to be employed for an air heater and the like, the PTC thermister is provided with a honeycomb structure.

It is known from U.S. Pat. No. 4,032,752 that an ohmic electrode is provided on both ends of the PTC thermister having the honeycomb structure. Due to the inherent properties of a PTC thermister, of a negative temperature coefficient of resistance and a low resistance below the Curie point, a considerably high current is conducted through the PTC thermister body and the ohmic electrode until the temperature level of the PTC thermister body arrives at the Curie point, such considerably high current appears directly after the application of electrical power to the PTC thermister. As a result of the facts mentioned above, a portion, particularly a central portion, of the ohmic electrode may be partly burned due to sparks between the ohmic electrodes and the PTC thermister body. Furthermore, the current source may be destroyed or made inoperable due to the high current conduction. Since the high current is conducted at while the temperature is abruptly increased up to the Curie point, such current is hereinafter referred to as a rush current.

It is known from German Auslegeschribt No. 1665880 that, in order to form the ohmic electrodes on the PTC thermister body a screen printing method of an ohmic paste composed of a main component which is silver and an additional component which is indium or gallium is used to form a coating layer, which is then baked. The silver electrode produced by the process of the Auslegeschribt mentioned above involves a problem with regard to migration of silver at a low temperature. That is, deterioration of the electrode is liable to occur because indium and gallium, having a lower melting point than silver, induce migration of silver onto the peripheral surface of the honeycomb PTC thermister body. This migration is more conspicuous in a honeycomb PTC thermister body than in a solid heating body without the through-holes.

It is an object of the present invention to provide a migration free and reliable heating element, in which the value of the rush current is decreased from the value of the rush current of the conventional PTC heating apparatus.

In accordance with the object of the present invention, there is provided a heating element comprising a semiconductor ceramic body having a number of through-holes, the material of said semiconductor ceramic body having a positive temperature coefficient of resistance over the Curie point, characterized in that a non-ohmic electrode is provided on at least one end of said semiconductor ceramic body.

The present invention will be hereinafter explained in detail with reference to the drawings, wherein.

Figure 1:
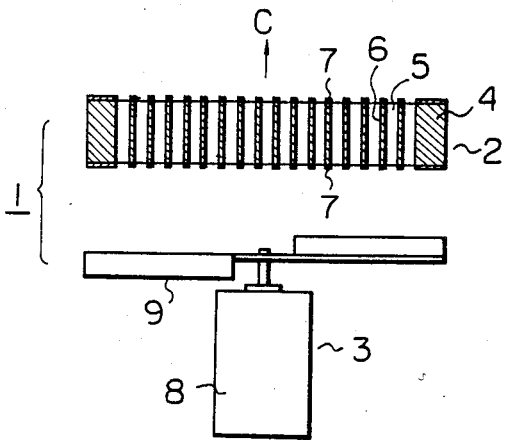
FIG. 1 is a cross sectional side view of a heating apparatus according to an embodiment of the present invention.

In FIG. 1, the heating device generally denoted as 1 comprises a honeycomb PTC heating body 2 and a fluid circulating means, such as a blower 3, for forced blowing of fluid into the heating body 2. The honeycomb PTC heating body 2 consists of a PTC thermister element 4 provided with a number of through-holes 5 and non-ohmic electrodes 7 on the upper and lower surfaces of partitions 6. The partitions 6 are in the form of a lattice defining the through-holes. The thickness of the partitions 6 may be from 0.20 to 0.45 mm and the area of the through-holes relative to the upper or lower surface area of the PTC thermister element 4 may be from 30 to 70%.

The honeycomb PTC thermister element 4 may be composed of any known PTC thermister material, but is preferably composed of such a PTC thermister material as disclosed in U.S. patent application Ser. No. 882,922, filed by Shioi (one of the present Applicants) et al., now U.S. Pat. No. 4,232,214.

Generally, the shape of the PTC thermister element 4 is columnar. Round, rectangular, square or hexagonal shaped channels or through holes, extend through the columnar body generally parallel to eath other. The solid parts of the PTC thermister body have an almost uniform thickness with one another and constitute the partitions for defining the through-holes or channels. The non-ohmic electrodes are connected to the opposite ends of the partition wall parts by means of a screen printing technique, and the like.

The non-ohmic electrodes 7 mainly consist of an electrically conductive metal, such as silver, gold or copper, and additionally, of an adhesive oxide(s), suoh as a lead borosilicate glass (frit). A metal for providing the ohmic contact between the electrode and PTC thermister, such as In, Ga, Zn, Cd, Bi and Sn, is not included in the non-ohmic electrodes according to the present invention.

Figure 2:
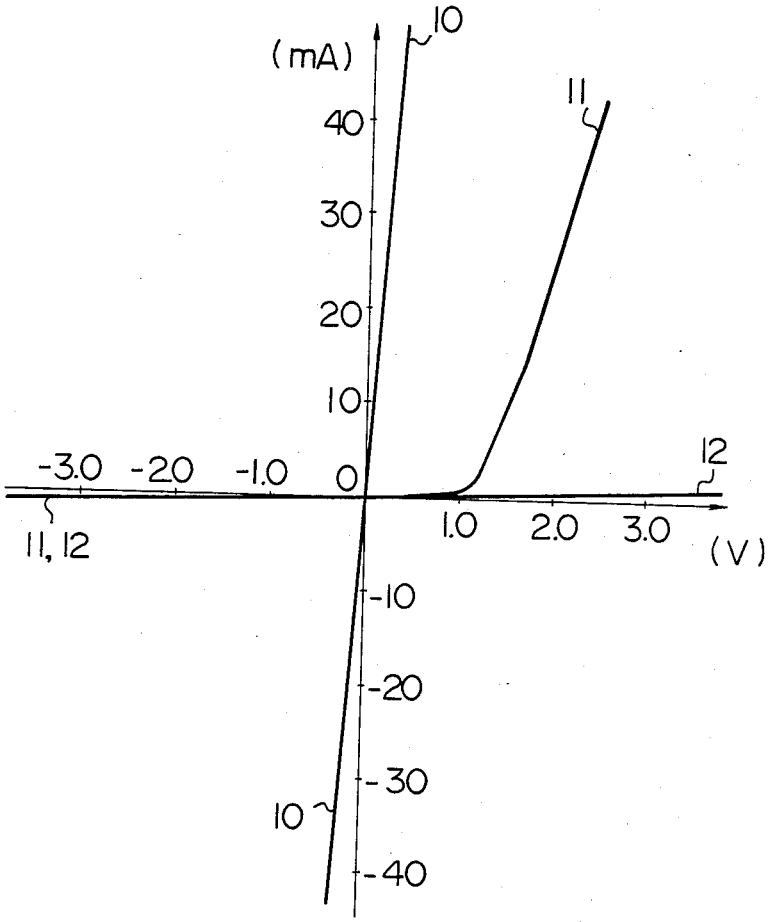
FIG. 2 is a graph of a current and voltage characteristic of PTC thermisters with various electrodes.

In FIG. 2, the V-I characteristic of several electrodes is shown. The ohmic electrodes composed mainly of silver and indium have a linear V-I characteristic as indicated by line 10. When a non-ohmic silver electrode is formed on one of the ends of the PTC thermister body and an ohmic silver-indium electrodes is formed on the other end, the V-I characteristic as indicated by line 11 exhibits a rectifying property at a voltage of 1.0 volt or lower. When the non-ohmic silver electrode is formed on both ends of the PTC thermister body, the current through the PTC thermister body is very low as shown by line 12 at a voltage range of FIG. 2 due to the rectifying effects of the non-ohmic electrodes.

According to a process for the formation of the non-ohmic electrodes, a silver paste comprising mainly silver powder, an adhesive oxide(s), an organic binder and a solvent is applied on both ends mentioned above and baked at a temperature of from 600° to 700° C. The non-ohmic electrodes produced after the baking consist of from 90 to 99, preferably from 95 to 98%, of silver and from 2 to 5% of the adhesive oxide(s). The non-ohmic electrodes have a thickness of from approximately 7 to 30 microns, preferably from 15 to 25 microns.

Although the non-ohmic electrodes are formed on both ends of the honeycomb PTC heating element 2 in the embodiment shown in FIG. 1, it is also possible to form the non-ohmic electrode on one of the ends and to form a conventional ohmic electrode on the other end of the honeycomb PTC heating element 2. It is preferable to form the non-ohmic electrode on the end which is exposed to ambient air, rather than the other end of the honeycomb PTC heating element. In the case of using an ohmic electrode, it is preferable to manufacture the same by a spraying method, rather than the screen printing method. The non-ohmic electrodes do not contain indium and gallium, which induce the migration of silver and also lower the resistance of the electrodes to weather. R. Shioi (one of the present Inventors) and T. Yamauchi have proposed in U.S. patent application Ser. No. 14,283, filed on Feb. 22, 1979, that a honeycomb PTC heating element be provided with a two or three layer electrode, so as to improve the reliability of the electrode. The single layer structure of the electrodes according to the present invention can satisfactorily resist weather and, therefore, it is possible to reduce the production cost of the heating apparatus as compared with the honeycomb PTC heating element proposed in the application mentioned above.

The blower 3 consists of an electrical motor 8 and blowing vanes 9 secured to the shaft of the electrical motor 8.

In the heating apparatus as explained above, the rush current is conducted directly after the application of current through the honeycomb PTC heating element 2. The rush current can be suppressed to a relatively low level because of the contact resistance between the non-ohmic electrodes 7 and the PTC thermister element 2.

Accordingly, it is possible to prevent accidents caused by abnormal current, such as the burning of electrodes in the heating appratus or the melting of a fuse and breaking of a circuit braker in the power supplying apparatus.

Figure 3:
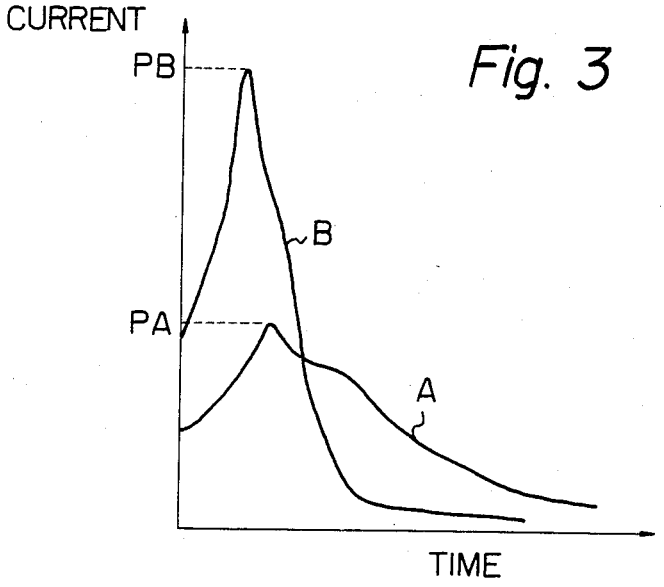
FIG. 3 is a graph of a transitional characteristic of PTC thermisters.

In FIG. 3, a transient phenomenon of the current through the PTC heating element with the non-ohmic electrodes (curve A) and the ohmic electrodes (curve B) is illustrated. The current through the PTC heating element provided with the non-ohmic electrodes exhibits a lower rush current (PA) than the rush current (PB) of the element provided with ohmic electrodes. The ratio of PA/PB can be ½ or lower in accordance with the present invention. After a lapse of from 10 seconds to less than 20 seconds subsequent to the initiation of the current conduction through the honeycomb PTC heating body 2, the current through the PTC heating body 2 is stabilized, and the current conduction approaches the stabilized state as heat is generated in the body 2. The flow of fluid, such as air which is forcedly blown by means of the blower 3, is heated to a desired temperature during passage through the through-holes 5, and fed out of the honeycomb heating element as indicated by the arrow C in FIG. 1.

Figure 4:
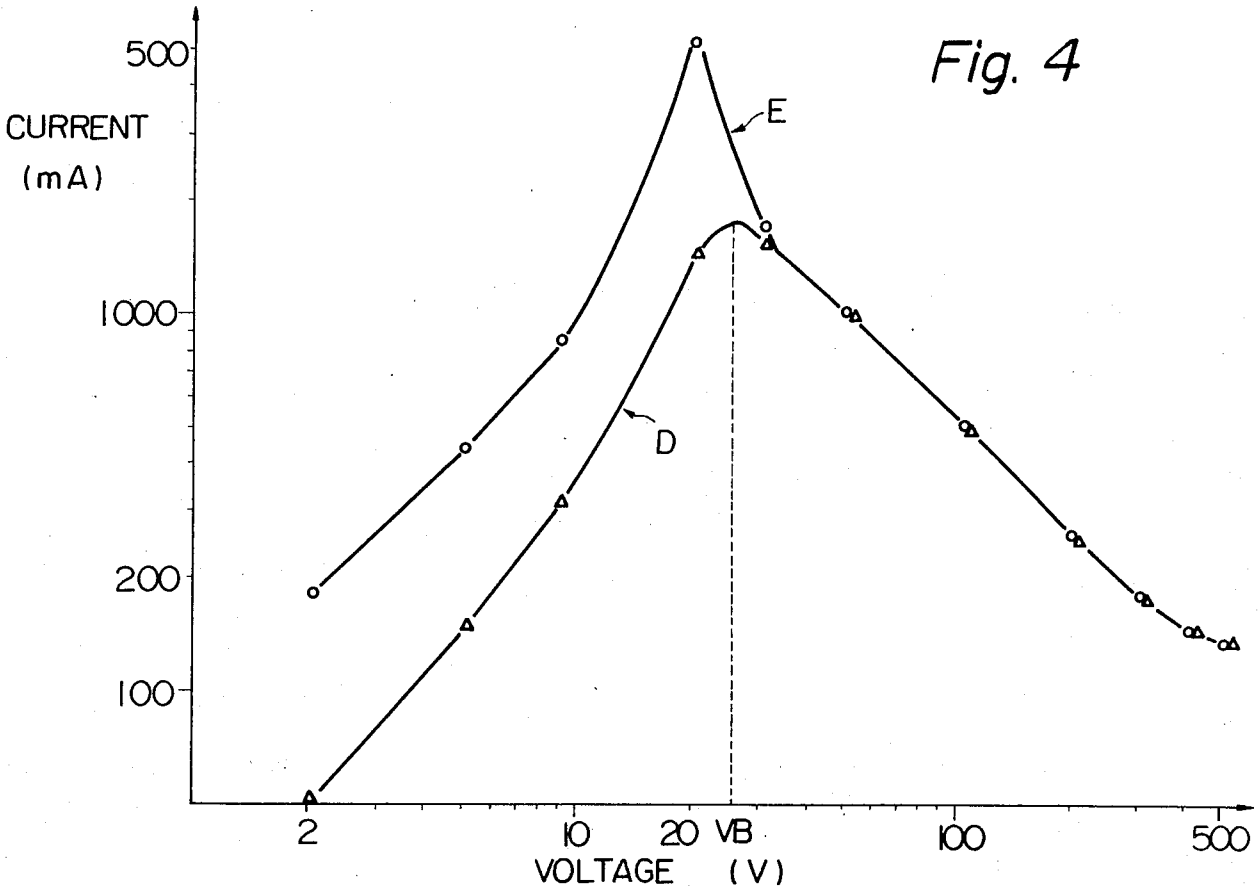
FIG. 4 is a graph of a current and voltage characteristic in a logarithm scale.

Referring to FIG. 4, a current variance with the voltage applied to the PTC heating body 2 with a non-ohmic electrode and an ohmic electrode is indicated by the curve D and curve E, respectively. To obtain the results indicated in FIG. 4, the voltage was varied from 2 to 500 V. As will be seen in FIG. 4, the curves D and E coincide with one another when the voltage becomes slightly higher than the voltage value $V_B$. When the honeycomb PTC heating element 2 is used with a voltage at or above the above-mentioned coinciding point, the electric power consumption is constant. It is, therefore, apparent that the honeycomb PTC heating element 2 according to the present invention can generate essentially the same amount of heat as that of the conventional honeycomb PTC heating element with ohmic electrodes.

The present invention will now be further explained by way of Example.

EXAMPLE

The main composition of a PTC thermister was prepared in a powdered form so that the composition contained 54 weight % of BaO, 12 weight % of PbO, 33.8 weight % of $TiO_2$ and a semiconductor forming element, i.e. $Y_2O_3$, in an amount of 0.2 weight %. Manganese in an amount of 0.02 weight % was added to the main composition and the powder was shaped by a sintering method into a honeycomb structure as illustrated in FIG. 1. In the sintering process, the ingredients were mixed by a ball mill, compressed, presintered at a temperature of 1100° C., pulverized to grain sizes of from 2 to 10 microns and mixed with an organic binder of polyvinyl alcohol in an amount of 2% by weight. The mixture of the presintered ceramic material and the organic binder was then extruded through the dies, so as to shape the mixture into a honeycomb structure, and then, sintered at a temperature of from 1250° C. to 1300° C. The resistance of the PTC thermister at 20° C. was 25 ohm. The diameter and thickness of the honeycomb body 1 were 50 mm and 3.5 mm, respectively. A number of through-holes 5 having a 1 mm width were defined by the partition wall 6 having a 0.2 mm thickness. The Curie point of the honeycomb PTC thermister was 190° C. A paste consisting mainly of approximately 90% of silver particles, approximately 4% of lead borosilicate glass and an organic binder was applied on both ends of the surfaces of the partitions 6 of the PTC thermister, by means of a screen printing method, and then, baked at a temperature of 600° C., thereby providing a non-ohmic electrodes 7 which was 20 microns thick.

Power from a commercial alternating current source of 100 volt was applied to the honeycomb PTC heating body 2 through a conductor (not shown) coupled to the electrodes in such a manner that one operation cycle, consisting of one minute conduction and one minute interruption, was repeated for twenty cycles. After the power application, it was observed that none of the non-ohmic electrodes were burned.

What we claim is:

1. A heating element comprising a semiconductor ceramic body of a honeycomb column-shaped structure, having flat perforated end surfaces and through-holes perpendicular thereto defining partitions, the material of said semiconductor ceramic body having a positive temperature coefficient of resistance over a Curie point and composed of barium titanate, wherein a pair of electric conductive layers are connected to the flat, perforated end surfaces of said semiconductor ceramic body and are electrically connected to a source for supplying power to said semiconductor ceramic body, and wherein at least one of said electric conductive layers is a non-ohmic electrode consisting of an adhesive oxide and an electrically conductive metal which is silver.

2. A heating apparatus according to claim 1, wherein said electrically conductive metal is contained in said non-ohmic electrode in an amount of from 90 to 99% by weight, the balance being said adhesive oxide.

3. A heating apparatus according to claim 2, wherein said non-ohmic electrode has a thickness of from 7 to 30 microns.

4. A heating element according to claim 2, wherein the thickness of the partions of said through-holes is from 0.20 to 0.45 mm, and the area of said through-holes relative to the total surface of said semiconductor body is from 30 to 70%.

* * * * *

UNITED STATES PATENT AND TRADEMARK OFFICE

CERTIFICATE OF CORRECTION

PATENT NO. : 4,654,510

DATED : March 31, 1987

INVENTOR(S) : KAZUMASA UMEYA ET AL

It is certified that error appears in the above-identified patent and that said Letters Patent is hereby corrected as shown below:

On the cover page, Item [73], change "TDK Electronics Co., Ltd." to --- TDK Corporation ---.

Signed and Sealed this

Eighth Day of September, 1987

*Attest:*

DONALD J. QUIGG

*Attesting Officer*

*Commissioner of Patents and Trademarks*